US012385427B2

(12) United States Patent
Salvadori et al.

(10) Patent No.: US 12,385,427 B2
(45) Date of Patent: Aug. 12, 2025

(54) VEHICLE EXHAUST SYSTEMS

(71) Applicant: AGCO International GmbH, Neuhausen (CH)

(72) Inventors: David Salvadori, Beauvais (FR); Einstein Huayanay, Beauvais (FR); David Briand, Beauvais (FR)

(73) Assignee: AGCO International GmbH, Neuhausen (CH)

( * ) Notice: Subject to any disclaimer, the term of this patent is extended or adjusted under 35 U.S.C. 154(b) by 0 days.

(21) Appl. No.: 18/716,622

(22) PCT Filed: Nov. 15, 2022

(86) PCT No.: PCT/IB2022/060962
§ 371 (c)(1),
(2) Date: Jun. 5, 2024

(87) PCT Pub. No.: WO2023/119000
PCT Pub. Date: Jun. 29, 2023

(65) Prior Publication Data

US 2025/0027436 A1 Jan. 23, 2025

(30) Foreign Application Priority Data

Dec. 21, 2021 (GB) ..... 2118593

(51) Int. Cl.
*F01N 13/14* (2010.01)
*F01N 13/18* (2010.01)

(52) U.S. Cl.
CPC ..... *F01N 13/141* (2013.01); *F01N 13/1855* (2013.01); *F01N 2260/20* (2013.01);
(Continued)

(58) Field of Classification Search
CPC ..... F01N 13/141; F01N 13/1855; F01N 2260/20; F01N 2450/16; F01N 2450/24; F01N 2510/02
(Continued)

(56) References Cited

U.S. PATENT DOCUMENTS 4,998,597 A 3/1991 Bainbridge et al.
5,966,933 A * 10/1999 Ishihara ..... F01N 13/08 285/330

(Continued)

FOREIGN PATENT DOCUMENTS

CN 213743623 U * 7/2021
JP S509821 U 1/1975
KR 100783866 B1 * 12/2007

OTHER PUBLICATIONS

European Patent Office, International Search Report related to International Patent Application No. PCT/IB2022/060962, mail date Feb. 9, 2023, 11 pages.

(Continued)

*Primary Examiner* — Jorge L Leon, Jr.

(57) ABSTRACT

A heat shield arrangement (14) for shielding the environment surrounding the junction between two sections (10, 13) of insulated vehicle exhaust from heat emanating from uninsulated end portions of the junction of the exhaust sections. The heat shield (14) is of tubular form and mounted on the insulation surrounding one section (10) of the exhaust and is slidingly movable between a first position (14') in which the junction between the two sections is exposed to allow access to work on fastening means (15) for holding the two sections together and a second position (14") in which the shield surrounds the junction and overlaps the ends of the insulation on both sections of the exhaust to insulate the surrounding environment.

12 Claims, 5 Drawing Sheets

(52) U.S. Cl.
CPC ..... *F01N 2450/16* (2013.01); *F01N 2450/24* (2013.01); *F01N 2510/02* (2013.01)

(58) Field of Classification Search
USPC ..... 60/323
See application file for complete search history.

(56) References Cited

U.S. PATENT DOCUMENTS

| | | | | |
|---|---|---|---|---|
| 10,927,744 | B2 | 2/2021 | Willats et al. | |
| 2019/0135201 | A1* | 5/2019 | Herzig | F01N 13/1811 |

OTHER PUBLICATIONS

UK Intellectual Property Office, Search Report for related UK Application No. GB2118593.9, dated May 25, 2022, 3 pages.

* cited by examiner

VEHICLE EXHAUST SYSTEMS

CROSS-REFERENCE TO RELATED APPLICATIONS

This application is a national phase entry under 35 U.S.C. § 371 of International Patent Application PCT/IB2022/060962, filed Nov. 15, 2022, designating the United States of America and published in English as International Patent Publication WO 2023/119000 A1 on Jun. 29, 2023, which claims the benefit of the filing date of U. K. Patent Application 2118593.9 "Vehicle Exhaust System," filed Dec. 21, 2021, the entire disclosure of which is incorporated herein by reference.

FIELD

This disclosure relates to vehicle exhaust systems and in particular to heat shield arrangements for shielding the environment surrounding the junction between two sections of insulated vehicle exhaust from heat emanating from the uninsulated end portions of the junction of the exhaust sections.

BACKGROUND

Heat shield arrangements exist in which a shield of heat-insulating material is fixed in position over the uninsulated end portions at the junction of the exhaust sections, the shield having an aperture therein to give access to clamps or other fixtures which connect the sections of the exhaust. These arrangements are therefore not satisfactory as the access aperture allows escape of significant heat from the junction and also allows debris from the environment to enter under the shield, thus creating a significant fire risk. This is particularly significant if the vehicle is an agricultural tractor in which straw and other highly combustible debris is prevalent.

It is an object of the present disclosure to provide an improved exhaust joint shield arrangement which mitigates the above problems.

BRIEF SUMMARY

Thus according to the present disclosure, there is provided a heat shield arrangement for shielding the environment surrounding the junction between two sections of insulated vehicle exhaust from heat emanating from uninsulated end portions of the two exhaust sections at the junction, the heat shield being of tubular form and mounted on a first section of the exhaust and being movable between a first position in which the junction between the two sections is exposed to allow access to work on fastening means for holding the two sections together and a second position in which the shield surrounds the junction and overlaps the ends of the insulation on both sections of the exhaust to insulate the surrounding environment.

The shield may be mounted to the insulation on the first exhaust section. The shield may slide longitudinally along the first exhaust section between its first and second positions. Spline formations may be provided on the first section of the exhaust and on the shield to facilitate the sliding between the first and second positions.

In an alternative arrangement, the shield may be rotated about the first exhaust section when moving between the first and second positions. Complementary screw thread formations may be provided on the first exhaust section exhaust and on the shield to facilitate the rotation between the first and second positions.

Such arrangements provide a simple but effective way to shield the environment from the heat emanating from the exhaust junction and prevent debris from entering under the shield when the shield is in its second (operative) position. Full access to the joint is also provided with the shield in its first position to allow connecting and disconnecting of the exhaust sections.

A securing arrangement may be provided to hold the shield in its second position during use of the vehicle.

This securing arrangement may conveniently comprise screws, bolts, or other fasteners carried by the movable shield, which engage the insulating material surrounding the other section of the exhaust or with nuts or other fasteners carried by this insulating material.

In such an arrangement, a nut welded or otherwise secured to the shield may carry a bolt or screw which engages the insulating material surrounding the other exhaust section or passes through the insulating material to clamp onto the other exhaust section.

Alternatively, the securing arrangement can comprise a magnetic latch to hold the shield in its second position.

First stop means may be provided for contact by the shield to define the first position of the shield.

Similarly, second stop means may be provided for contact by the shield to define the second position of the shield.

The first stop means and/or the second stop means may comprise a stop ring secured to the first section of the exhaust.

The shield may comprise a metallic outer skin enclosing a volume of insulation material. The insulation material may comprise an insulation wool. The outer skin may comprise stainless steel.

BRIEF DESCRIPTION OF THE DRAWINGS

The present disclosure will now be described, by way of example only, with reference to the accompanying drawings in which.

DETAILED DESCRIPTION

Figure 1:
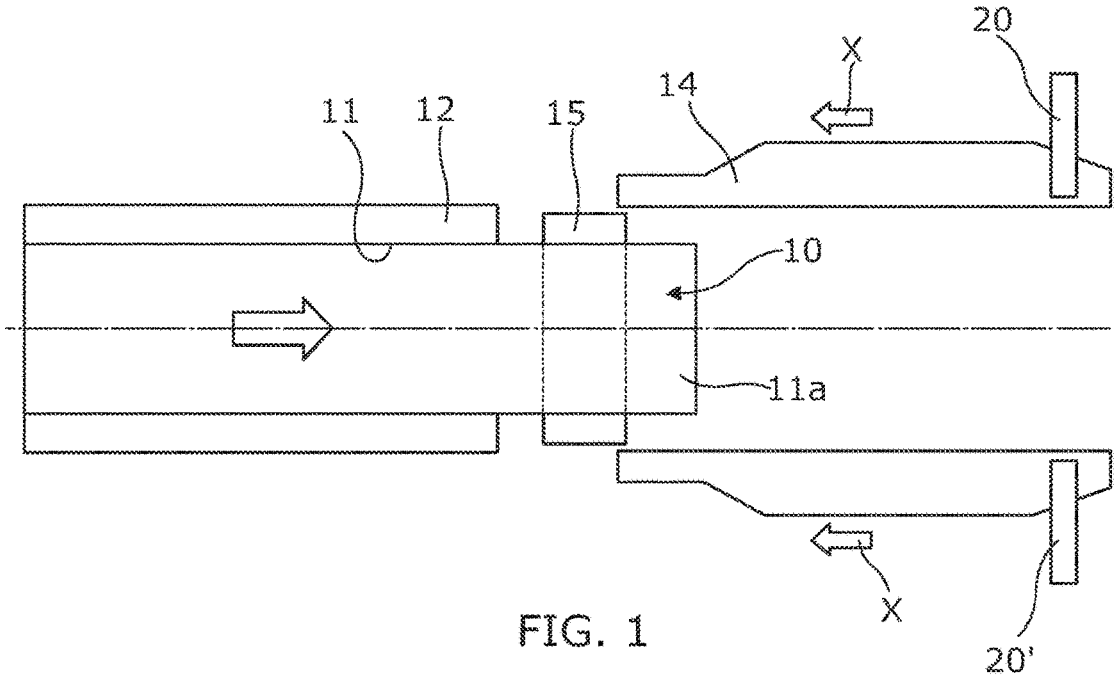
FIG. 1 shows diagrammatically the mounting of a heat shield in accordance with the disclosure on a first insulated section of a vehicle exhaust.

Referring to the drawings, a first exhaust section 10 has an inner metal tube 11 which is surrounded by an outer insulating material 12 except at an end portion 11*a*, which is to be joined to a second exhaust section 13 (see FIG. 2) by a clamp or other fastening means 15 for joining the two sections together at a junction. A tubular heat shield 14 in accordance with the present disclosure made from heat-insulating material is mounted on exhaust section 10 by, for example, sliding or screwing the heat shield 14 along or around the section 10 in the direction of arrows X in FIG. 1. Splines or screw threads may be provided on the section 10 and the heat shield 14 to facilitate the movement of the shield. Alternatively, the heat shield 14 may simply slide longitudinally on the outer surface of the insulating material 12.

In one embodiment, the heat shield 14 has an inner metal tubular layer which includes the splines or screw threads. In an alternative construction, no metal inner layer is used, and the splines or screw threads are formed in the insulating material 12 of the heat shield 14.

Figure 2:
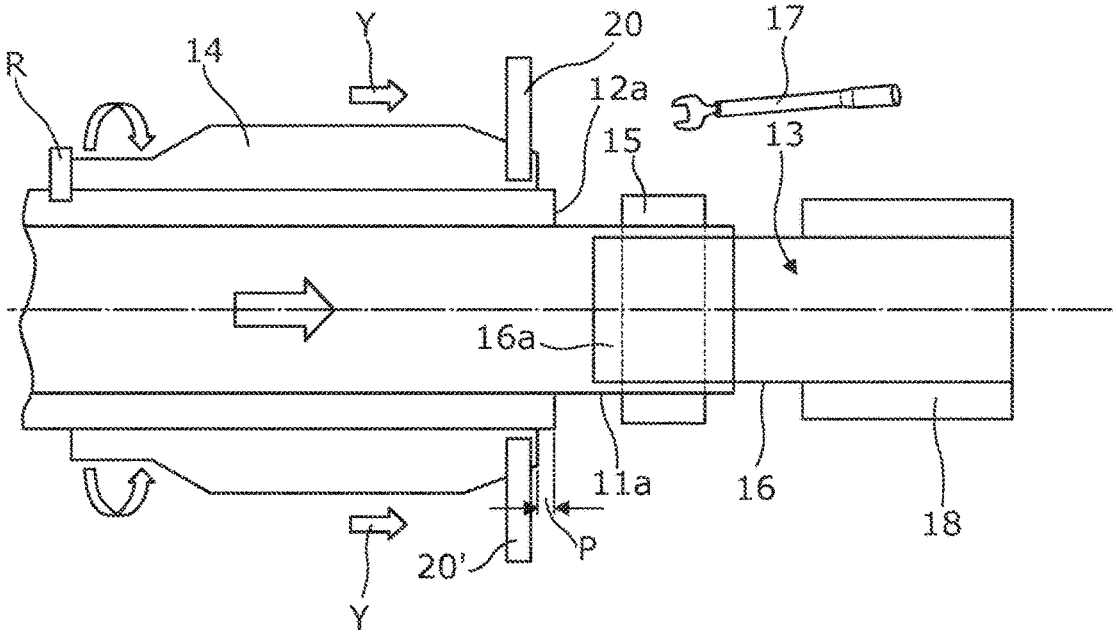
FIG. 2 shows diagrammatically the connection of a second section of insulated exhaust with the shield in its retracted position.

With the heat shield 14 in its first retracted position shown in FIG. 2, the exposed end portion 16*a* of the inner metal tube 16 of second exhaust section 13 of the exhaust is clamped inside the end portion 11*a* of first exhaust section 10 by the clamp or other fastening means 15 using the appropriate spanner or other tool 17. As can be seen with the heat shield retracted, its outer end is well back a distance P (typically 10 mm or more) from the end 12*a* of insulating material 12 to provide good access to the clamp 15 to facilitate the joining or separation of the exhaust sections 10 and 13. In an alternative embodiment, the end section 16*a* of the inner metal tube 16 of the second section 13 could be clamped outside the end portion 11*a* of the first exhaust section 10.

Figure 3:
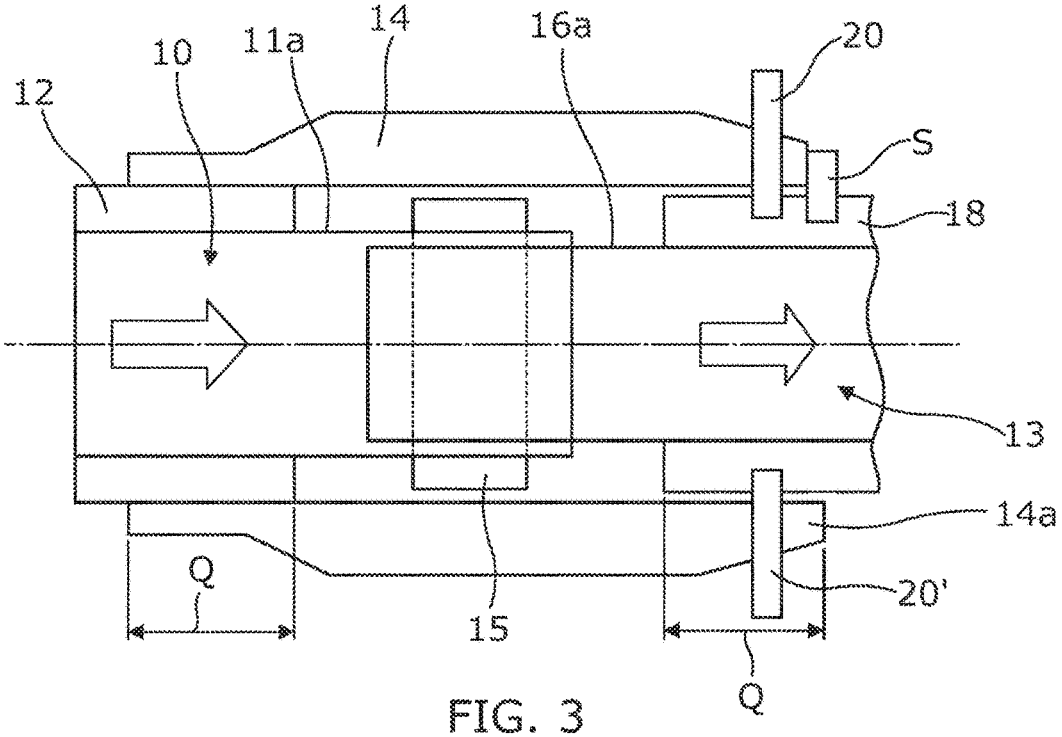
FIG. 3 shows diagrammatically the shield in its second operational position over the junction between the two exhaust sections.

The heat shield 14 is moved to its second operational position shown in FIG. 3 by sliding or rotating the shield around the insulating material 12 of first exhaust section 10 as indicated by arrow Y in FIG. 2 until the end 14*a* of the heat shield 14 surrounds the insulating material 18 of the second exhaust section 13. Typically, the heat shield 14 will overlap the insulating materials 12 and 18 at Q by 15 mm or more to complete the heat shielding of the joint between the two exhaust sections 10 and 13.

Stops R and S, shown diagrammatically in FIGS. 2 and 3, may be provided for contact by the ends of heat shield 14 to define the first and second positions of the heat shield 14. The stops R and S can be of any suitable shape and could be cylindrical, square, or annular, for example, and they may be differently shaped from one another.

Securing means of any suitable form may be provided to hold the heat shield 14 in its second position during use of the vehicle.

Figure 4:
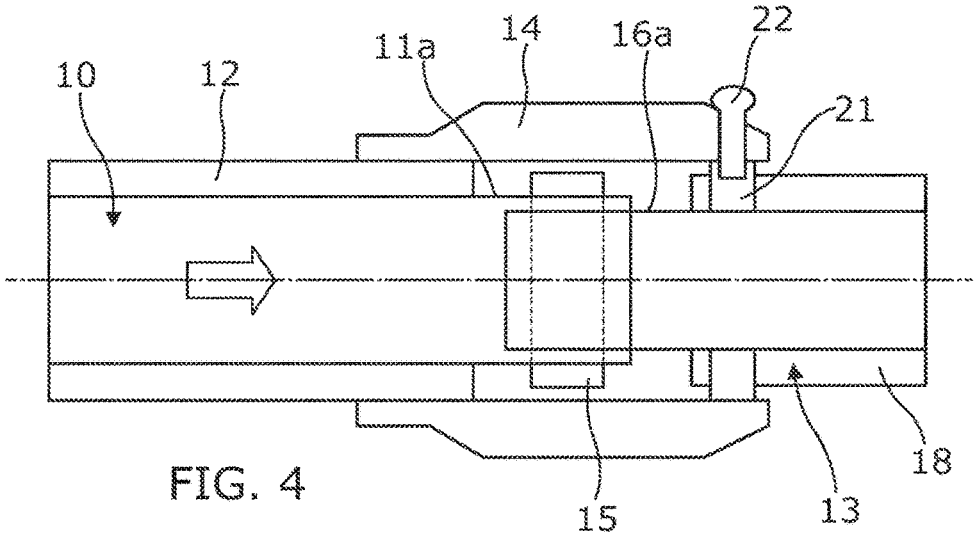
FIG. 4 shows one form of screw and nut securing means to hold the heat shield in its second operational position.

These securing means may, for example, conveniently comprise screws, bolts, or other fasteners 20 carried by the heat shield 14, which engage the insulating material 18 surrounding the second exhaust section 13 of the exhaust as shown in FIG. 3. In FIG. 4, a fastening means in the form of a screw 22 engages a nut or other fastener 21 embedded in insulating material 18.

Figure 5:
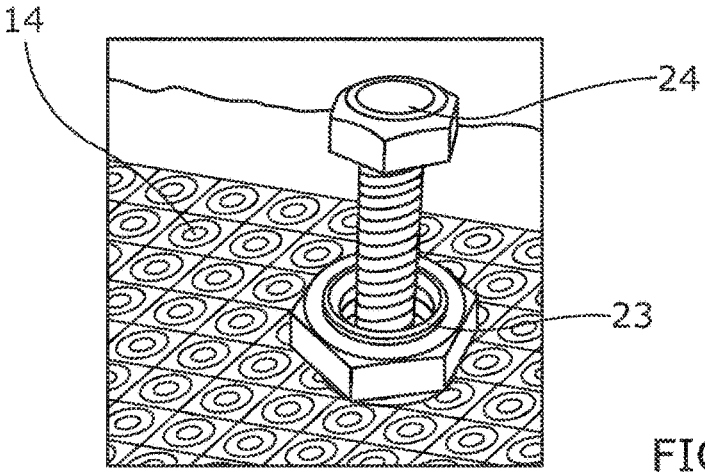
FIG. 5 shows another form of screw and nut securing means to hold the heat shield in its second operational position.

In another such arrangement, shown in FIG. 5, a nut 23 welded or otherwise secured to the heat shield 14 may carry a bolt or screw 24 which engages the insulating material 18 surrounding the second exhaust section 13 or passes through the insulating material 18 to clamp onto the inner metal tube 16 of the second exhaust section 13.

The heat shield 14 can be made from any suitable material that is both sufficiently heat-insulating in its second position and also sufficiently robust to withstand movement between its first and second positions, and which allows the use of fasteners such as 20, 20', 23, and 24 when work on the joint between the associated exhaust sections 10 and 13 becomes necessary.

If required, the heat shield 14 may be surrounded by a clamp (not shown) to close the gap between the inner surface of the heat shield 14 and the insulating material 18 of second exhaust section 13. In an embodiment, a clamp is used in addition to other fasteners 20, 20', and could be located, for example, to the left of the fasteners 20, 20' in FIG. 3. Alternatively, a clamp could be used on its own as a fastener. In a further alternative, the heat shield 14 is welded in position over the joint.

Figure 6:
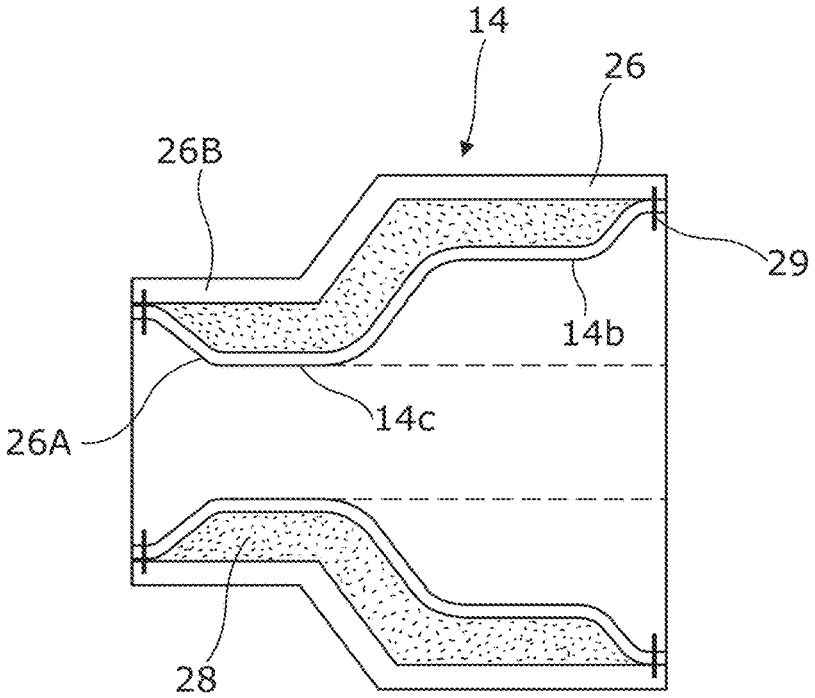
FIG. 6 is a diagrammatic, longitudinal cross-sectional view through a heat shield in accordance with an embodiment.

As illustrated in FIG. 6, the heat shield 14 may have a metallic outer skin 26 surrounding a volume of insulation material 28. The insulation material 28 may be an insulation wool, which may have a thickness of 10 to 15 mm. The metallic outer skin 26 may be made of any suitable metallic material. In an embodiment, it is made from a stainless steel such as AiSi 430 and may have a thickness of 0.10 to 0.20 mm. The metallic outer skin 26 in one embodiment is formed from a tubular inner skin portion 26A spot welded 29 to a tubular outer skin portion 26B about a peripheral region at either end of the heat shield 14, with the inner and outer skin portions 26A and 26B being separated by the insulation material 28 inside the peripheral regions. In this embodiment, over part of its length, the inner skin portion 26A extends parallel to and is a close sliding fit over the external surface of the insulating material 12 of the first exhaust section 10. If the heat shield 14 is provided with splines or a screw thread, these may be located in this region.

As indicated above, the heat shield 14 may or may not have a metal inner layer that includes splines or screw threads, and may also include plastic or composite insulating materials as well as or alternative to the insulating materials more commonly used around exhaust systems.

The external shape and cross section of the heat shield 14 may take any appropriate form depending on the proximity of the adjacent items surrounding the heat shield 14 on the associated vehicle. As illustrated in FIG. 6, the heat shield 14 may have a smaller diameter portion 14*c*, which is a close fit about the insulating material 12 on the first exhaust section 10, and a larger diameter head portion 14*b*, which locates about the junction between the two exhaust sections 10, 13 when it is in the second operative position. The larger diameter head portion 14*b* can be dimensioned to accommodate the clamp 15 or other mechanism used to join the two exhaust sections 10, 13 together.

Figure 7:
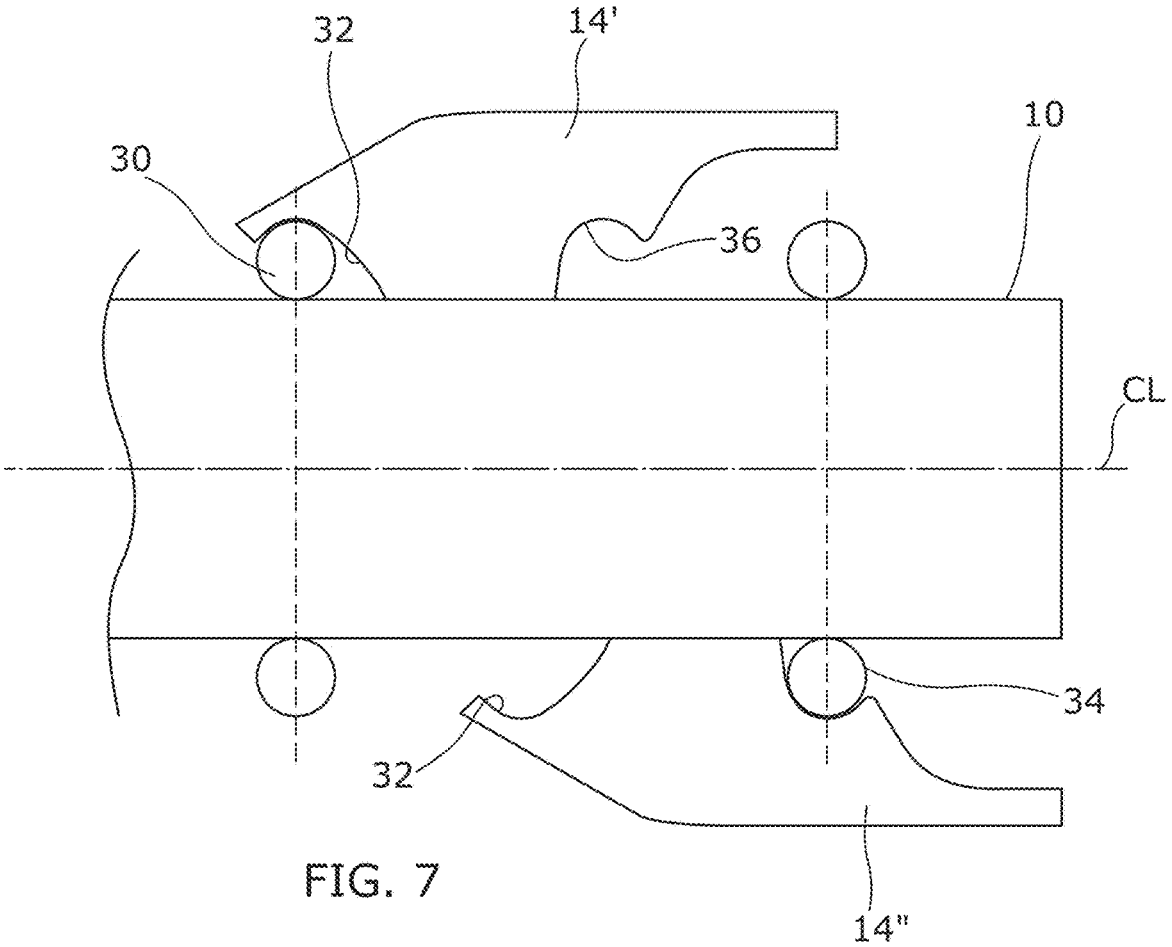
FIG. 7 illustrates an alternative arrangement for holding the heat shield in retracted and operational positions, the view being split to show the shield in the retracted position above the center line and in the operational position below the center line.

FIG. 7 illustrates an alternative arrangement for securing the heat shield 14 in the first, retracted position (14' illustrated above the center line CL) and the second, operative position (14" illustrated below the center line CL). In this embodiment, a first locking ring 30 is secured to the first exhaust section 10 and is resiliently engageable in a first locking formation 32 to hold the heat shield 14 in the first, retracted position 14'. Similarly, a second locking ring 34 is secured to the first exhaust section 10 and is resiliently engageable in a second locking formation 36 to hold the heat shield 14 in its second, operative position 14". The first and second locking formations 32 and 36 may be recesses defined in an inner surface region of the heat shield 14 in which the locking rings 30 and 34 are resiliently clipped. In an alternative embodiment, there may be only one locking ring 30, 34 and one locking formation 32, 36 to hold the heat shield 14 either in the first, retracted position 14' or in the second, operative position 14". In this case, an alternative locking arrangement could be used to hold the heat shield 14 in the second position. For example, one of the alternative locking arrangements could be adopted to hold the heat shield 14 in the second, operative position 14". The, or each, locking ring 30, 34 may be welded or otherwise secured about the insulating material 12 surrounding the first exhaust section 10. Welding may be appropriate if the insulating material 12 is surrounded by a metallic outer layer.

Figure 8:
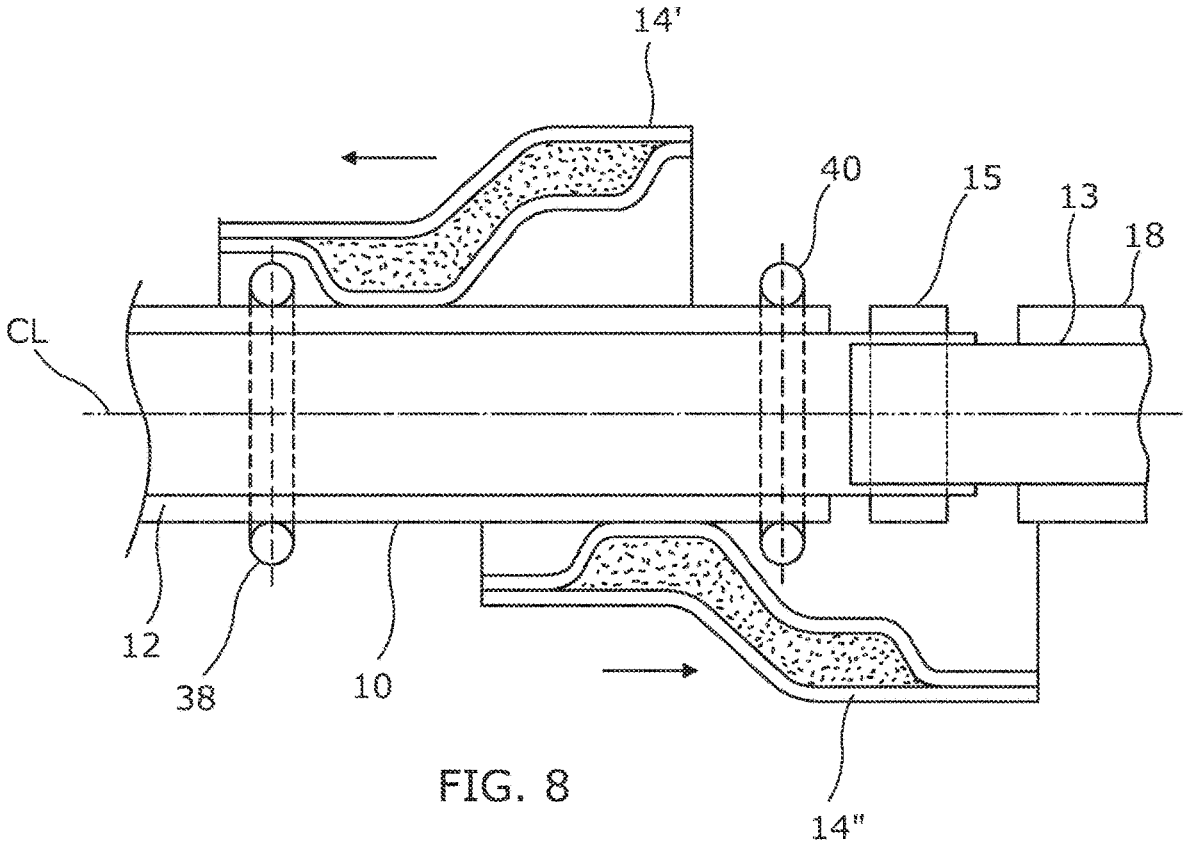
FIG. 8 is a view similar to that of FIG. 7, but illustrating the use of stop rings to define the retracted and operational position of the shield.

FIG. 8 illustrates a still further alternative embodiment in which stop rings 38, 40 are secured (e.g., welded) to the first exhaust section 10 to form first and second stops. The stop rings 38, 40 are arranged to contact the heat shield 14 to limit movement of the heat shield 14 between the first, retracted position 14' and the second, operative position 14". In this case, the stop rings 38, 40 serve only as stops similar to the stops R and S described above in relation to FIGS. 2 and 3. In a modification, at least one of the stops may be a magnetic component that holds the heat shield 14 in abutment with the stop rings 38, 40 to form a magnetic catch. If the heat shield 14 has an outer casing comprising a magnetic material, such as a magnetic stainless steel, one of the stop rings 38, 40 may be a magnet or have one or more magnets attached to it to magnetically attract and hold the heat shield 14. Alternatively, magnetic components may be attached to or incorporated into the heat shield 14. Other magnetic catch arrangements for magnetically holding the heat shield 14 in either the first, retracted position 14' and/or the second, operative position 14" can be used.

Figure 9:
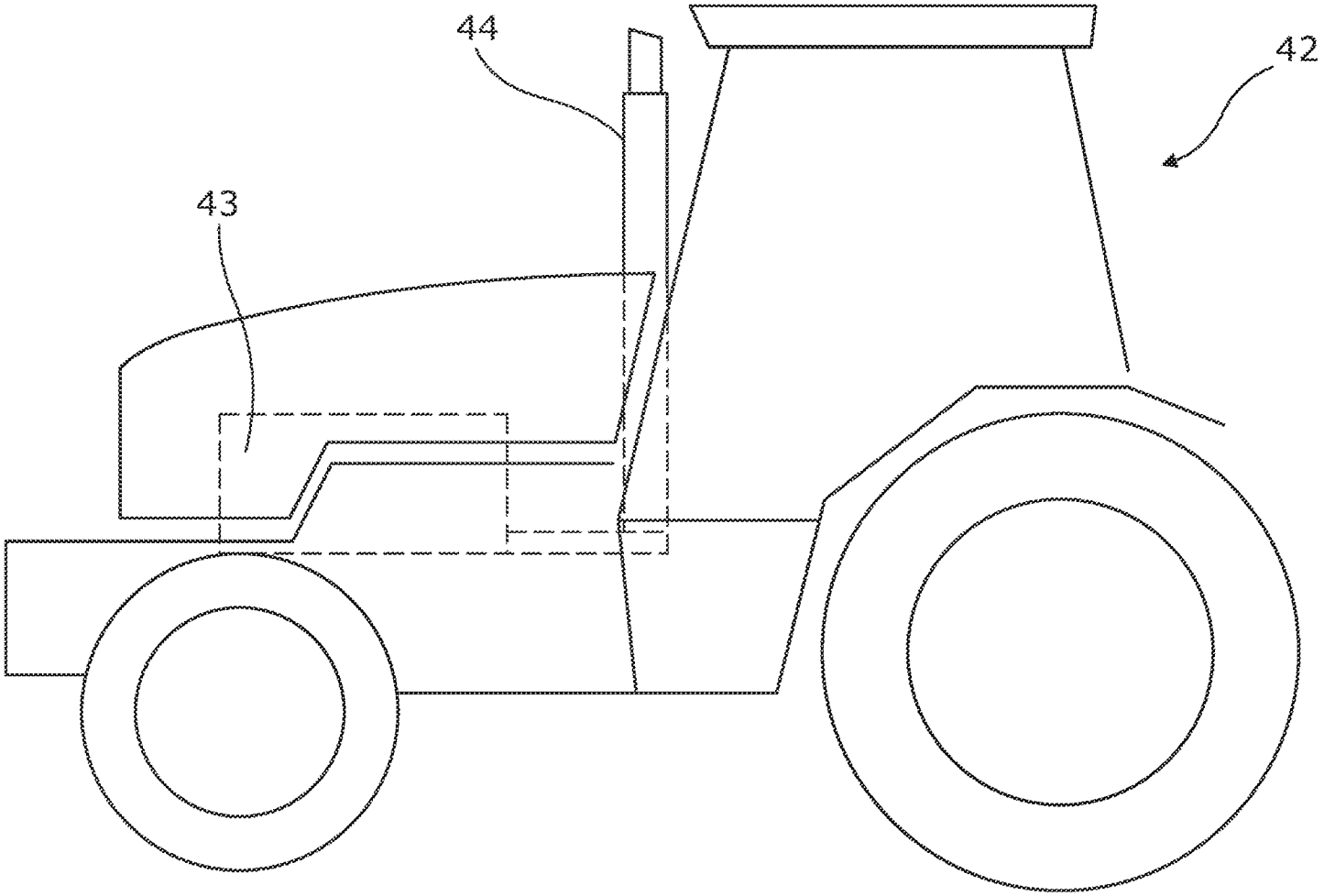
FIG. 9 illustrates schematically a vehicle in the form of an agricultural tractor having an exhaust system in which a heat shield in accordance with the disclosure can be incorporated.

A heat shield 14 in accordance with the disclosure may be incorporated into an exhaust system of any suitable vehicle, including agricultural vehicles and machines such as an agricultural tractor 42 illustrated schematically in FIG. 9. The tractor 42 has an engine 43, which may be an internal combustion engine, and an exhaust system 44 for directing exhaust gases from the engine to atmosphere. The exhaust system will typically comprise two or more exhaust sections 10, 13 connected together. The exhaust sections 10, 13 are insulated but have uninsulated end portions 11*a*, 16*a* that are joined together by means of a clamp 15 or other fixture in the manner described above in relation to FIGS. 1 to 8. A heat shield 14 in accordance with the disclosure can be used to enclose the joint to provide a heatshield for the uninsulated end portions 11*a*, 16*a*.

Figure 10:
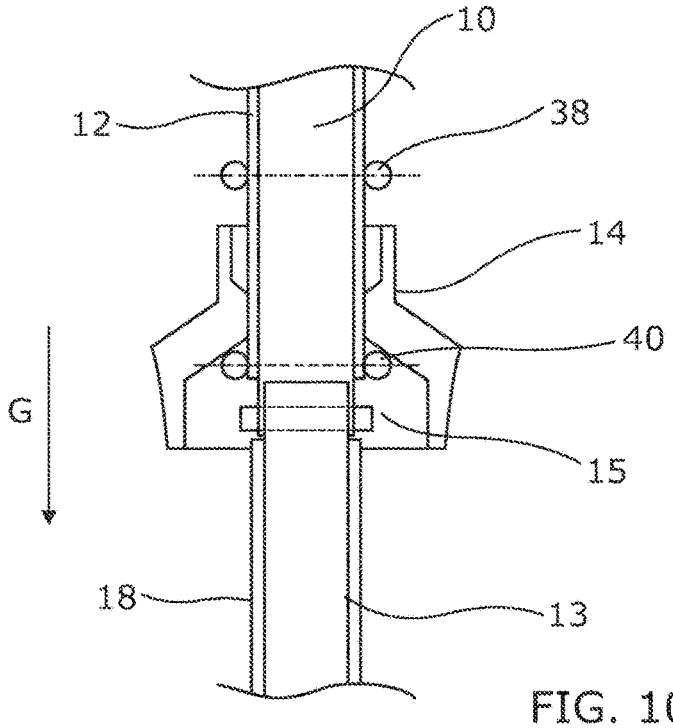
FIG. 10 illustrates use of the heat shield in a vertically aligned region of an exhaust.

As illustrated in FIG. 9, tractors and other vehicles often have exhaust systems that extend vertically over at least part of their length. In this case in which two sections of exhaust that are clamped together are aligned vertically, a heat shield 14 can conveniently be located about the uppermost of the exhaust sections as illustrated in FIG. 10. In this case, the heat shield 14 is moved toward the second, operative position 14" by the force of gravity, as indicated by the arrow G. As illustrated in FIG. 10, stop rings 38, 40 similar to those described above in relation to FIG. 8 may be used to limit movement of the heat shield 14. The heat shield 14 may be held in its second, operative position 14" by gravity alone. However, additional arrangements for securing the heat shield 14 in the second, operative position 14" can be used, including any of those described above.

The present disclosure thus provides a simple and effective solution for shielding the environment from heat emanating from exhaust section junctions and which also provides good access for connecting or disconnecting the exhaust sections while also preventing the ingress of debris under the heat shield during use of the vehicle.

The invention claimed is:

1. A heat shield arrangement for shielding surrounding environment of a junction between first and second insulated exhaust sections of a vehicle exhaust, the heat shield arrangement comprising:

a tubular heat shield mounted on the first insulated exhaust section, the heat shield configured to be moved between a first position and a second position;

wherein the junction between the first and second insulated exhaust sections is exposed in the first position to provide access to at least one fastener holding the first and second insulated exhaust sections together;

wherein the heat shield surrounds the junction in the second position and overlaps ends of the first and second insulated exhaust sections to insulate the surrounding environment;

wherein the heat shield is configured to slide longitudinally along the first insulated exhaust section when being moved between the first and second positions; and wherein corresponding spline formations are formed on the first insulated exhaust section and on the heat shield to facilitate the sliding of the heat shield between the first and second positions.

2. The heat shield arrangement of claim 1, wherein the spline formations of the heat shield are formed in a metal inner tubular layer of the heat shield.

3. The heat shield arrangement of claim 1, further comprising a securing arrangement configured to hold the heat shield in the second position.

4. The heat shield arrangement of claim 3, wherein the securing arrangement comprises first fasteners carried by the heat shield, the first fasteners configured to engage the second insulated exhaust section.

5. The heat shield arrangement of claim 4, wherein the first fasteners include a nut secured to the heat shield, the nut carrying a bolt of configured to engage the second insulated exhaust section.

6. The heat shield arrangement of claim 5, wherein the nut is welded to the heat shield.

7. The heat shield arrangement of claim 4, wherein the first fasteners comprise at least one fastener selected from the group consisting of screws and bolts.

8. The heat shield arrangement of claim 4, wherein the first fasteners are configured to engage second fasteners carried by the second insulated exhaust section.

9. The heat shield arrangement of claim 8, wherein the second fasteners include nuts.

10. The heat shield arrangement of claim 3, wherein the securing arrangement comprises a magnetic or resilient catch.

11. The heat shield arrangement of claim 1, further comprising a first stop configured to contact the heat shield when the heat shield is in the first position.

12. The heat shield arrangement of claim 1, further comprising a second stop configured to contact the heat shield when the heat shield is in the second position.

* * * * *